US007107925B2

(12) United States Patent
Wille et al.

(10) Patent No.: US 7,107,925 B2
(45) Date of Patent: Sep. 19, 2006

(54) WEATHERVANING LNG OFFLOADING SYSTEM

(75) Inventors: Hein Wille, Eze (FR); Jean-Pierre Queau, Nice (FR); Leendert Poldervaart, Monaco (MC)

(73) Assignee: Single Buoy Moorings Inc., Marly (CH)

( * ) Notice: Subject to any disclaimer, the term of this patent is extended or adjusted under 35 U.S.C. 154(b) by 100 days.

(21) Appl. No.: 10/498,494

(22) PCT Filed: Dec. 12, 2002

(86) PCT No.: PCT/EP02/14285

§ 371 (c)(1),
(2), (4) Date: Jun. 14, 2004

(87) PCT Pub. No.: WO03/049994

PCT Pub. Date: Jun. 19, 2003

(65) Prior Publication Data

US 2005/0039665 A1 Feb. 24, 2005

(30) Foreign Application Priority Data

Dec. 12, 2001 (EP) ..... 01204865

(51) Int. Cl.
*B63B 3/24* (2006.01)
*B63B 22/02* (2006.01)
*B67C 3/34* (2006.01)

(52) U.S. Cl. ..... 114/230.15; 441/5; 141/279

(58) Field of Classification Search ..... 441/3–5; 114/230.15; 141/279, 284, 287
See application file for complete search history.

(56) References Cited

U.S. PATENT DOCUMENTS

| | | | |
|---|---|---|---|
| 3,311,142 | A | 3/1967 | Bergstrom |
| 3,354,479 | A | 11/1967 | Dickson et al. |
| 3,908,576 | A | 9/1975 | Van Der Gaag |
| 3,969,781 | A | 7/1976 | Reid |
| 3,999,498 | A | 12/1976 | Flory |
| 4,098,212 | A | 7/1978 | Kemper et al. |
| 4,494,475 | A | 1/1985 | Eriksen |

FOREIGN PATENT DOCUMENTS

| | | |
|---|---|---|
| GB | 1 097 058 | 1/1968 |
| GB | 1 511 313 | 5/1978 |

OTHER PUBLICATIONS

Zubiate et al: "Single point mooring system for floating LNG plant" Ocean Industry,—Nov. 1978 pp. 75-78, XP008003458 cited in the application, the whole document.
Patent Abstracts of Japan, vol. 008, No. 047 (M-280), Mar. 2, 1984 & JP 58 202183 A (Mitsubishi Jukogyo KK), Nov. 25, 1983 abstract.

*Primary Examiner*—Jesus D. Sotelo
(74) *Attorney, Agent, or Firm*—Young & Thompson

(57) ABSTRACT

A cryogenic fluid offloading system, having a tanker vessel (2) moored in line with an offshore mooring construction (4, 8) and connected to a processing unit, such as regasification plant (13). The degasification plant (13) has no large storage facilities, the tanker (2) being unloaded in dependence on onshore demand for gas.

26 Claims, 9 Drawing Sheets

WEATHERVANING LNG OFFLOADING SYSTEM

BACKGROUND OF THE INVENTION

The invention relates to a cryogenic fluid offloading system comprising:

- an offshore mooring structure, connected to the seabed,
- a connecting member that is attached to the mooring structure with a first end to be displaceable around a vertical axis,
- a tanker vessel for loading cryogenic fluid at a first location, transporting it and offloading the cryogenic fluid at a second location, the tanker vessel being connected to the mooring structure via the connecting member,
- a first fluid duct connected to the mooring structure, for supplying fluid away from the mooring structure,
- a second fluid duct connected to the mooring structure, for transporting fluid coming from the tanker vessel to the mooring structure,
- a processing unit for receiving a cryogenic fluid in liquid phase from the tanker vessel and for supplying a gaseous phase of the fluid to the first fluid duct, and
- fluid supply means for controlling supply of cryogenic fluid from the tanker vessel to the processing unit.

DESCRIPTION OF THE RELATED ART

A weathervaning LNG offloading system is known from Zubiate, Pomonic, Mostarda, Ocean Industry, November 1978, page 75–78.

The known mooring structure comprises an articulated riser tower with a buoyancy chamber that is attached to a piled base via a universal joint. The top part of the riser tower projects above water level and is connected to a triangular mooring yoke via a tri-axial swivel and universal joint. The yoke is connected in two hinges to the stern of a floating LNG regasification barge. The yoke transporting LNG vapour to the tower riser system carries two cargo pipes. The tanker vessel is moored alongside the LNG barge, which has substantially the same length as the tanker.

Even though the combined tanker and LNG regasification barge can weathervane around the mooring tower, the offloading situation during weathervaning is relatively unstable. The tanker will therefore be docked to the regasification barge for a short period of time as possible and completely transfer its LNG to LNG storage facilities. Next, the tanker is decoupled from the barge and will leave to collect a next cargo, while the LNG stored in the regasification barge storage tanks is regasified and supplied through the pipeline extending from the riser tower along the seabed to shore.

SUMMARY OF THE INVENTION

It is an object of the present invention to provide a cryogenic fluid offloading system in which a tanker can be moored to the offshore mooring structure for a longer period of time in a stable weathervaning position.

It is a further object of the present invention to provide for a cryogenic fluid offloading system, which can employ a relatively small size regasification plant.

It is again another object of the present invention to provide a cryogenic fluid offloading system that can be easily produced and installed.

Thereto, the offshore cryogenic fluid offloading system according to the present invention is characterised in that the connecting member is connected with a second end to the tanker vessel, the mooring structure being at least substantially in line with the tanker vessel to allow displacement of the tanker vessel around the vertical axis, control means being provided for opening and closing of the fluid supply means on the basis of a predetermined supply of the gaseous phase through the first duct.

By attaching a tanker vessel in line to the mooring structure, a stable weathervaning situation is obtained. Weathervaning by displacement of the connecting member around the vertical axis can be through angles of ±180° or through smaller angles such as 90° or less, and can be in a single direction or in two directions, depending on prevailing wind and current conditions. According to the invention, the tanker vessel acts as the main LNG storage structure, which unloads LNG to the regasification plant only when there is demand from onshore, for instance from a power plant. When there is no onshore demand, the tanker is not being offloaded. Hence, the regasification plant need not have large LNG storage facilities and can be of relatively small size. Small buffer storage will suffice to ensure continued gas supply to shore when the tanker has been offloaded and is exchanged with another tanker. The buffer storage on the regasification plant can be of equal volume, preferably smaller than half of the volume or ⅓ of the volume of the LNG storage tanker of the tanker. Thereby, it is possible to moor the small size regasification plant alongside or at the bow of the tanker vessel, such that the weathervaning behaviour of the combined tanker and regasification plant is not affected in a negative manner.

Furthermore, the offloading system of the present invention can be easily installed by onshore construction of the regasification plant with the connecting member, which may be a space frame, floating it to the pre-installed mooring structure and connecting the regasification plant and connection member to the mooring structure.

In one embodiment, the connection member is an arm, for instance a space frame, having a longitudinal section that is with one end connected at or near the midpoint of the tanker vessel. The arm extends in the length direction along the vessel towards the mooring structure and has a transverse section attaching to the mooring structure. The transverse arm section allows the tanker vessel to be placed in line with the mooring structure so that it can weathervane under the influence of wind and current conditions around the mooring structure. The longitudinal section of the arm preferably is at least ⅓, more preferably at least ½ of the length of the tanker vessel, such that it can be connected near the midship position. The arm supports the LNG-duct, which may be rigid or which may comprise flexible piping. By means of the arm, according to the present invention, regular tanker vessels can be employed with midship loading and offloading facilities to be moored to the offloading system of the present invention and to be used as a storage facility for the regasification plant.

In one embodiment, the longitudinal section of the mooring arm is at its end, near the midship position of the vessel, provided with a floating structure for supporting the weight of the arm. On the floating structure, the regasification plant may be placed so that it is moored along side the vessel. The dimensions of the floating structure and the regasification plant supported on the floating structure are not more than ⅔ preferably not more than ½ of the length of the tanker vessel.

The transverse part of the mooring arm may be connected to a buoy, which is provided with a turntable that is anchored to the seabed so that the buoy can weathervane around the stationary mooring lines. In one embodiment, the regasification plant is placed on said buoy. Alternatively, the mooring structure may comprise a tower, placed on the seabed, having a fender system in the form of a vertical arm and weights depending from the vertical arm above or below sea level. A buoy is connected to the fender weights via a transverse rod. The regasification plant is placed on the buoy, which is attached to the transverse section of the mooring arm.

In again another embodiment, the regasification plant is placed on a tower above water level, the transverse section of the mooring arm being attached to a buoy that is connected to the tower via a soft yoke construction or via a rotatable hinging construction. For offloading of LNG to the regasification plant, a transfer duct may be employed as shown in European patent application no. 01202973.2, filed in the name of the applicant. The hinging LNG-offloading arm, having a number of articulations allows for heave, surge, sway, yaw roll and pitch motions of the tanker vessel, while allowing safe LNG-transfer to the regasification plant.

BRIEF DESCRIPTION OF THE DRAWINGS

Some embodiments of a cryogenic fluid offloading system according to the present invention will be described in detail with reference to the accompanying drawings. In the drawings.

DESCRIPTION OF THE PREFERRED EMBODIMENTS

Figure 1:
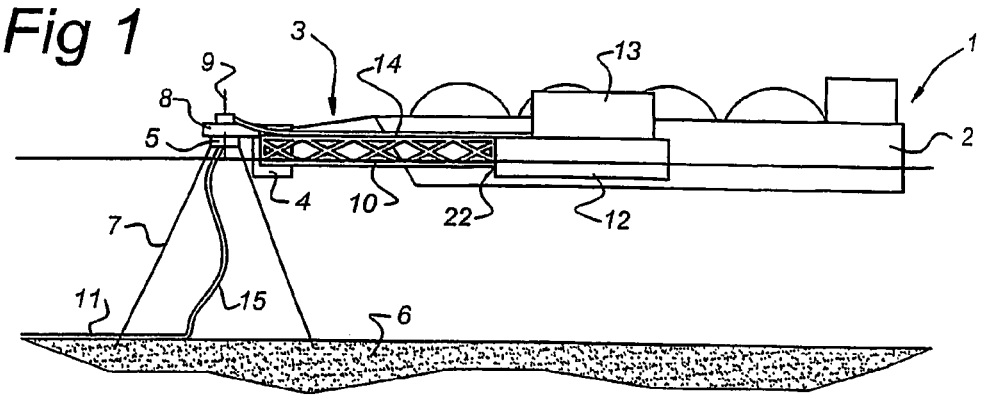
FIG. 1 and FIG. 2 show a side view and a top plan view of a midship offloading system using a mooring arm and a regasification plant moored alongside the tanker vessel.

FIG. 1 shows the cryogenic offloading system 1 according to the present invention. The system comprises an LNG-tanker 2 and an offshore mooring structure 3. The offshore mooring structure 3 comprises a buoy 4 attached to a chain table 5. The chain table 5 is anchored to the seabed 6 via anchor chains or mooring lines 7. The upper part 8 of the buoy 4 can rotate relative to the stationary part 5 around vertical axis 9. The buoy 4 is connected to the vessel 2 via a connecting member, or space frame 10 extending alongside the tanker 2. The frame 10 is attached with a first end 22 to a floating structure 12 on which a processing unit 13 is placed. The processing unit 13 is in the embodiments described herein a regasification plant, but can comprise other equipment for LNG processing, such as an LNG pressurisation station and a vapour liquefaction installation.

Figure 2:
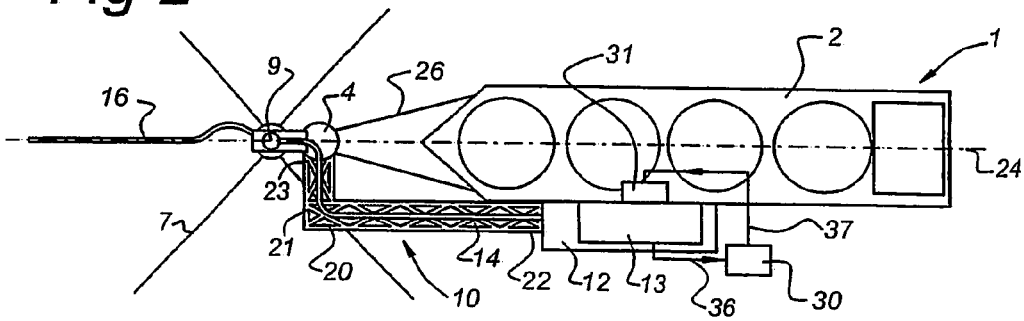

The floating structure 12 is moored alongside the tanker 2 as can be clearly seen in FIG. 2. The regasification plant 13 and the floating structure 12 are of relatively small size and are not longer than ⅔, preferably smaller half the length of the tanker vessel 2. From the regasification plant 13 a fluid duct 14 extends to the mooring structure 3 and is attached to a vertical fluid riser 15 via a swivel construction on the mooring structure 3, which is not shown in detail. The fluid riser 15 connects to a pipe line 16 for transporting natural gas to an onshore processing station, such as for instance a power plant.

As can be seen from FIG. 2, the frame 10 comprises a longitudinal frame section 20 extending alongside the vessel 2 and a transverse frame section 21, connecting with a second end 23 of the frame 10 to the buoy 4. Hereby, the vessel 2 can be placed with its longitudinal centreline 24 intersecting the vertical axis 9 so that the vessel 2 can properly weathervane in a stable manner around the mooring structure 3. In addition, the vessel may be attached through cables 26 or a delta-yoke construction to the buoy 4. The frame 10 may comprise pivoting segments to allow relative motion in a horizontal plane and "fishtailing" of the vessel.

Furthermore, the offloading system 1 comprises control means 30, which may be formed by a flow sensor and a computing device for determining the flow of gas through the pipe line 16 towards the shore. Alternatively, control unit 30 may have another input for determining the demand of gas flow through duct 16 such as a manual input or an electrical or radiographical input from another computing device. In response to the desired gas flow through pipe line 16, the control unit 30 controls fluid supply means 31, which may comprise one or more valves connecting or disconnecting the LNG-tanks on the vessel 2 with the regasification plant 13. Signal lines 36, 37 for providing electrical or hydraulical control signals to the control means 30 and to the fluid supply means 31 have been schematically indicated. When no demand for gas flow through pipe line 16 is present, the fluid supply means 31 will be closed whereas the control means 30 will be opening the fluid supply means 31 when gas flow through the pipe line 16 is required. Hence, the vessel 2 functions as the LNG storage facility for the regasification plant 13 and is moored to the mooring structure 3 for a longer or shorter period, depending on the demand for gas supply through pipe line 16. As no substantial additional storage facilities are required for the regasification plant 13, it can be of relatively small size so that it can be moored alongside the vessel 2 without affecting the weathervaning capacities of the tanker 2.

Figure 3:
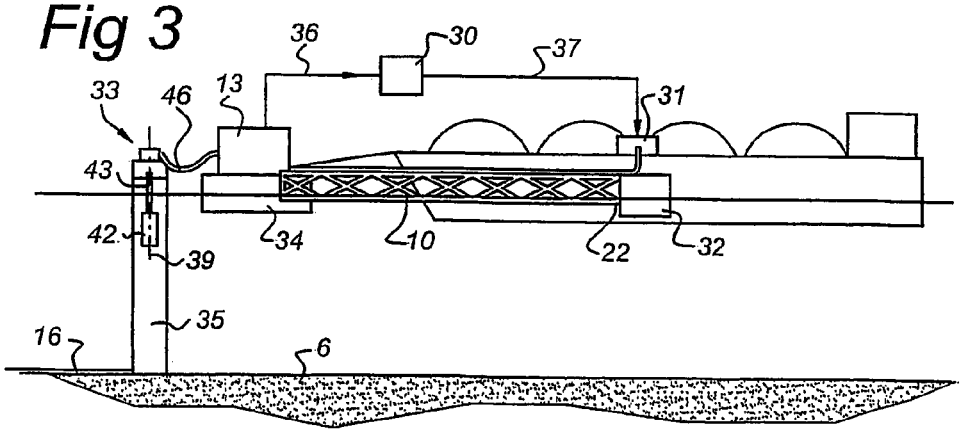
FIG. 3 and FIG. 4 show a side view and a top plan view of an offloading system in which the vessel is moored to a floating regasification plant.
Figure 8:
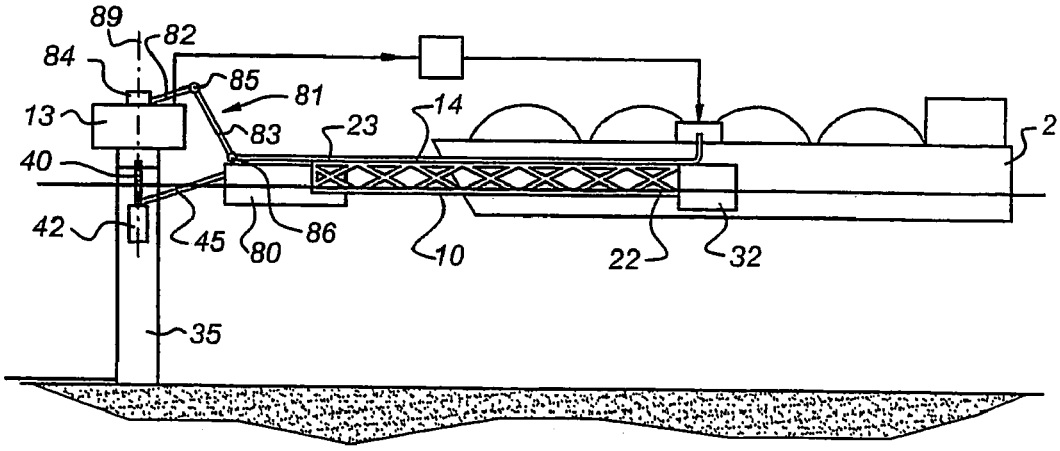
FIG. 8 and FIG. 9 show embodiments wherein the vessel is moored to an offshore tower, the regasification plant being placed on the tower.
Figure 9:
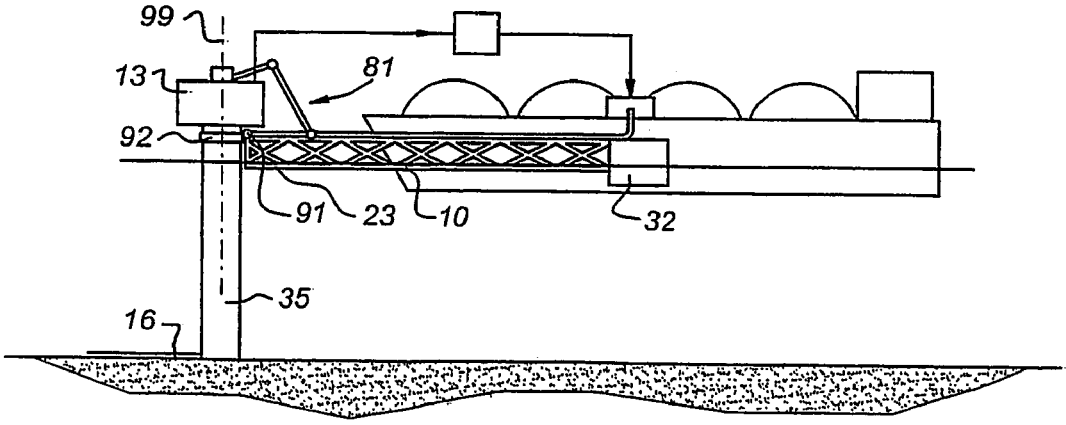

In the embodiments, shown in FIGS. 1 and 2, the transverse frame section 21 is shown to extend perpendicular to the longitudinal frame section. It is, however, also possible to have the transverse frame section 21 extend at a lesser angle to the longitudinal frame section. Again, alternatively the transverse arm section 21 could be omitted in case of a large diameter buoy 4, the longitudinal arm section 20 in that directly connecting to the side of such large diameter buoy 4. In order to guarantee a continuation of gas supply from the regasification unit 13 to onshore, upon exchange of a tanker when the old tanker is empty and a new tanker will be moored or when environmental conditions require disconnecting of the tanker. Buffer storage tanks for LNG can be placed on the floating unit 12 of the regasification unit 13 or on a mooring tower such as shown in FIGS. 3, 8 and 9. The buffer tanks on the regasification unit are no larger than the volume of the tanker, preferably not larger than half the volume, more preferably not larger than ⅓ of the volume.

FIG. 3 shows an embodiment wherein the regasification plant 13 is placed on a buoy 34. The buoy 34 is attached to the transverse section 21 of the frame 10. It should be noted that in case the buoy 34 is of the same width dimension as the vessel 2, only a longitudinal frame section 20 is sufficient for connecting the fluid duct 14 to the midship position of the vessel 2. The first end 22 of the frame 10 is attached to a floater 32 for horizontally positioning the arm 10 alongside the tanker 2. The second end 23 of the frame 10 is attached to the buoy 34. The buoy 34 is attached to a tower 35 placed on the seabed 6 and projecting above water level. The tower 35 comprises a transverse arm 40 from which weights 41, 42 depend from rods or cables 43. The buoy 34 is connected to the weights 41, 42 via arms 44, 45.

Again, the longitudinal centreline 24 of the vessel 2 intersects the vertical axis 39 so that the vessel 2 can weathervane through about ±90° around the vertical axis 39. Upon weathervaning, the weights 41, 42 will be deflected and provide a restoring force on the vessel 2 driving it back to assume its equilibrium position. The fluid duct 14 is attached to the regasification plant 13 for supplying LNG to the plant. An outlet of the plant 13 is connected via flexible riser 46 to a vertical gas duct which is incorporated within or alongside the tower 35 and which connects at the bottom thereof to pipe line 16 for transport of gas to the shore.

In an alternative embodiment, the fluid supply means 31 may also be connected to the duct 14 at the side of the regasification plant 13.

Figure 5:
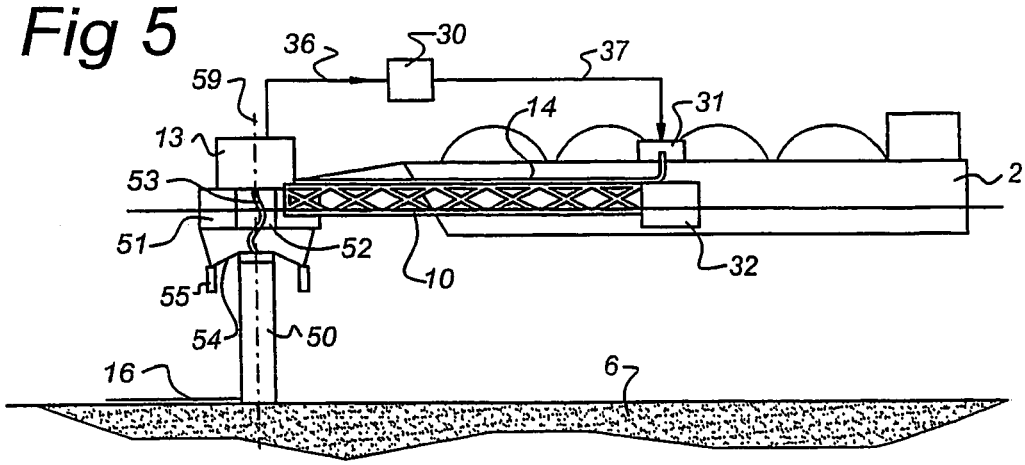
FIGS. 5–7 show alternative embodiments of an offloading system in which the vessel is moored to a floating regasification plant.

In the embodiment shown in FIG. 5, the arm 10 is attached to a buoy 51 having a central shaft 52. The regasification plan 13 is placed on the buoy 51. A submerged tower 50 anchors the buoy 51 via cables 54 and weights 55 providing a fender system, which restores the position of the buoy 51 upon rotation or drift relative to the tower 50. A flexible gas line 53 extends through the shaft 52 and connects the regasification plant 13 to the tower 50 and is, via the tower 50, in fluid connection with pipe line 16.

Figure 6:
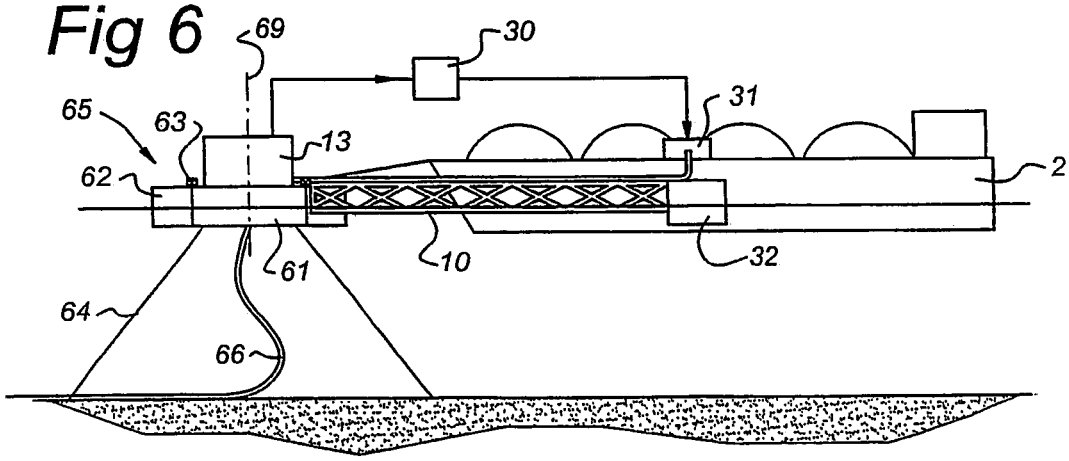

In the embodiment shown in FIG. 6, the arm 10 is connected to outer ring 62 of a buoy 65. On the buoy 65, the regasification plant 13 is supported. The outer ring 62 can rotate via axial/radial bearings 63 around the inner, stationary part 61 of the buoy 65. The inner part 61 is anchored to the seabed 6 via anchor lines 64. A flexible fluid line 66 connects the gas pipe 16 to the regasification plant 13. The tanker vessel 2 can weathervane through 360 degrees around vertical axis 69.

Figure 7:
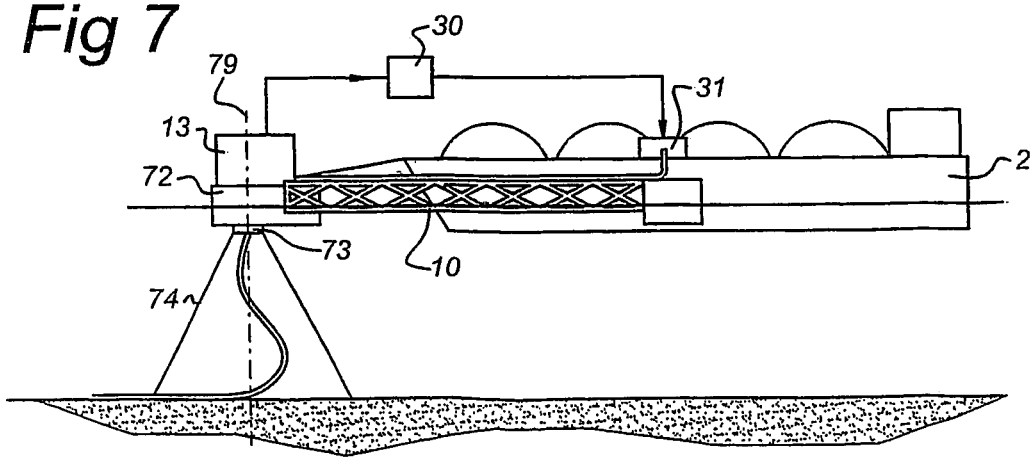

In the embodiment in FIG. 7, the buoy 72 supporting the regasification plant 13 is at its bottom provided with a turntable 73 to which anchor lines 74 are connected. The buoy 72 can rotate with respect to the turntable 73 via bearings, which are not disclosed in detail herein.

Figure 4:
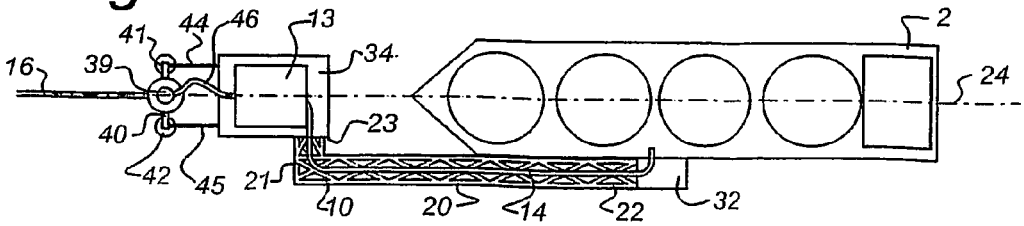

In the embodiment shown in FIG. 8, a tower 35 of similar construction as shown in FIGS. 3 and 4 is used, comprising restoring weights 42, depending from arms 40 connected to arms 45. A floating construction 80 supports the second end 23 of the arm 10 whereas floating structure 32 supports first end 22 of arm 10. The gas pipe line 16 is connected to LNG-duct 14 via an articulated arm 81 comprising a first section 82 extending in a substantially horizontal orientation and a second section 83 depending vertically from the first section 82. The arms 82, 83 have articulations 84, 85, 86, which may comprise seven swivel joints, such as described in European patent application no 01202973.2, in the name of the applicant. The arms 82, 83 may be hollow arms comprising the LNG-duct or may the arms along which the LNG-duct is guided externally.

FIG. 9 discloses an embodiment wherein the second end 23 of the arm 10 is connected to the tower 35 in a pivot joint 91. A collar 92 around the tower 35 allows rotation around vertical axis 99.

The offloading system, as described above, may be easily installed by onshore construction of the mooring arm 10 and connecting it to the floating regasification plant 13 of relatively small size. Separately, the mooring structure, such as tower 35, can construct at the mooring site. The regasification plant, together with the floating arm 10, can be transported to the site of the tower together and can there be connected, during which the regasification plant can remain on the floating structure, such as shown in the embodiments of FIGS. 1–7 or can be transferred to the mooring tower, such as shown in the embodiments of FIGS. 8 and 9.

Figure 10:
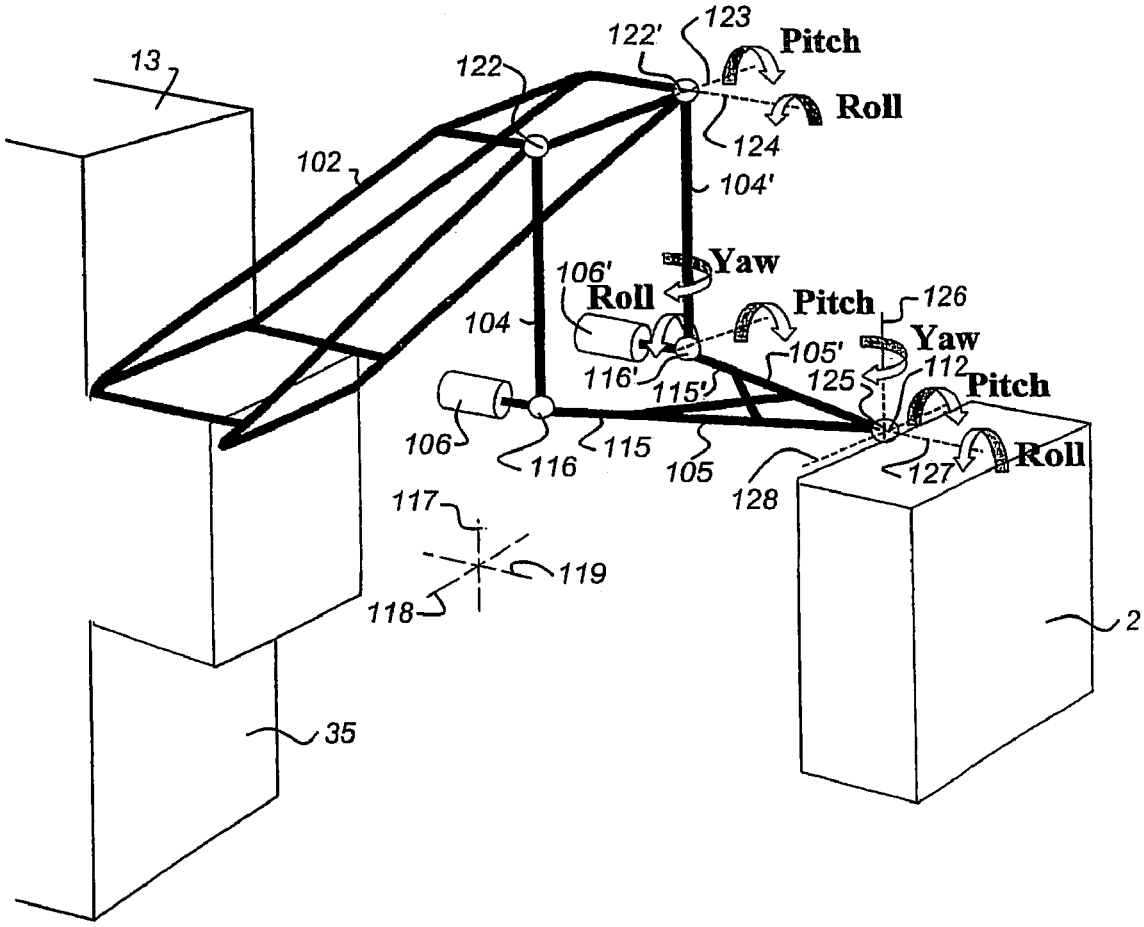
FIG. 10 shows a schematical perspective view of a further embodiment of the mooring system comprising a bow offloading system.

As can be seen from FIG. 10, a support structure 102 placed on the tower 35 carries the mooring arms 104, 104' and 105, 105'. The horizontal mooring arms 105, 105' are with their restoring end parts 115, 115' connected to a respective vertical arm 104, 104' via articulation joints 116, 116'. Two counterweights 106, 106' are connected to the restoring end parts 115, 115' of each arm 105, 105'. The articulation joints 116, 116' may for instance comprise three perpendicular circular bearings, or ball-joints allowing rotation around a vertical axis 117 (yaw), a transverse axis 118 (pitch) and a longitudinal axis 119 (roll).

The vertical mooring arms 104, 104' are at their upper ends connected to the support structure 102 in articulation joints 122, 122' allowing rotation of the arms 104, 104' around a transverse axis 123 and a longitudinal axis 124. At the coupling end part 125, the arms 105, 105' are provided with a mechanical connector 113 (FIG. 11) allowing rotation around a vertical axis 126 (yaw), a longitudinal axis 127 (roll) and a transverse axis 128 (pitch). The mechanical connector is not shown in detail but may be formed by a construction such as described in U.S. Pat. No. 4,876,978 in the name of the applicant, which is incorporated herein by reference.

Figure 11:
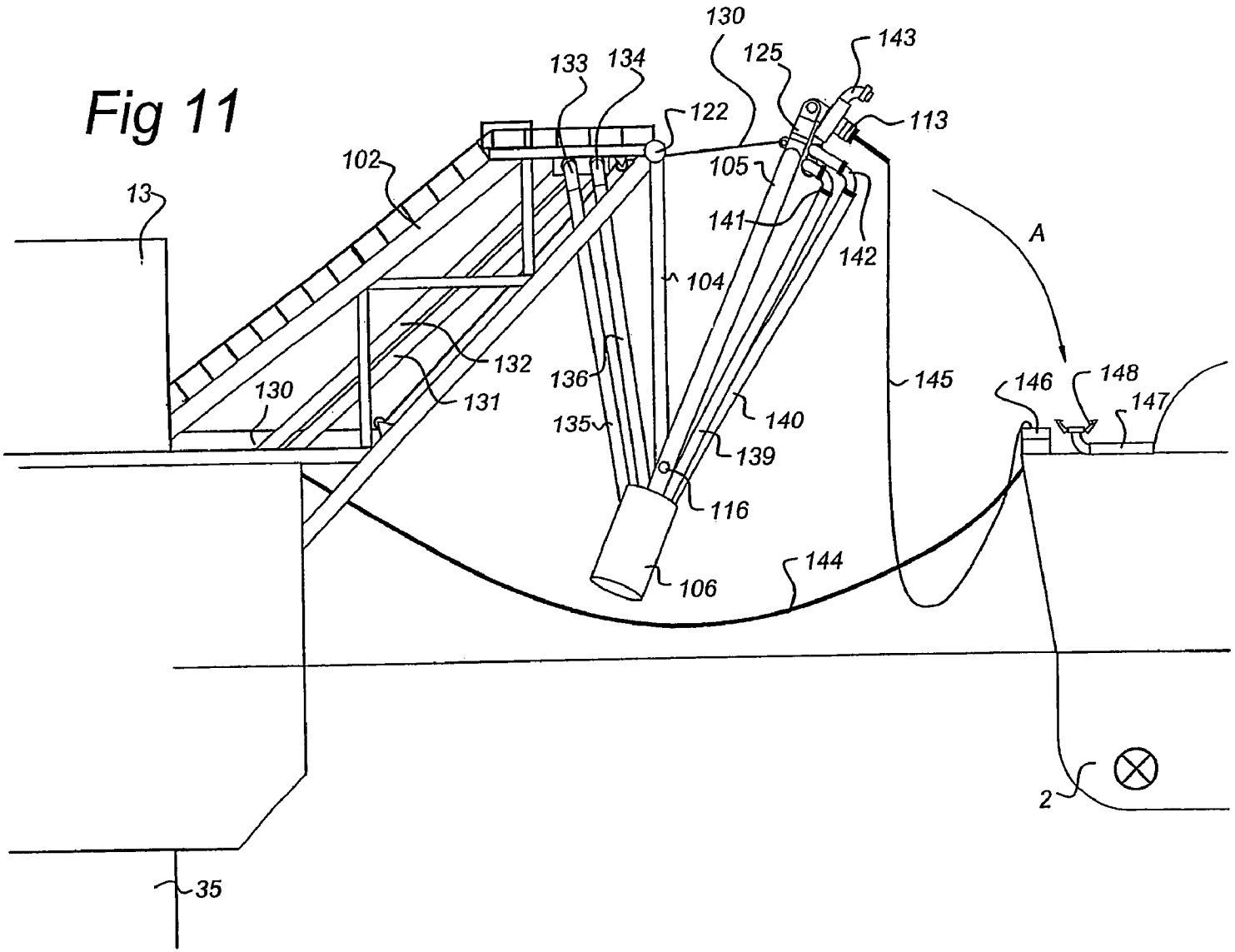
FIG. 11 and FIG. 12 show a side view of a mooring system of FIG. 10 in a disconnected and in a connected position.

FIG. 11 shows the mooring arms 105 that are placed in a substantially vertical position via a cable 130 attached to the coupling end part 125 of the arms 105, 105' and connected with its other end to a winch (not shown) on the tower 35. Two rigid pipes 131, 132 extend from the tower 35 to a swivel connection 133, 134 on the support structure 102. From the swivel connections 133, 134 two vertical pipes 135, 136 extend downwardly to swivel connections 137, 138 (see FIG. 12). Two horizontal cryogenic transfer pipes 139, 140 extend along the arms 105, 105' to swivel connections 141, 142 on the mechanical connector 113. A fluid connector 143 is provided on the mechanical connector 113.

During connecting of the mooring arms 105, 105' to the vessel 2, the vessel 2 may be connected to the tower 35 via a hawser 144. Via a pilot line 145, the mechanical connector 113 can be lowered and placed into a receiving element 146 on deck of the vessel 2. By paying out cable 130, the horizontal arm 105 pivots in articulation joints 116, 116' around the transverse axis 118. The vertical ducts 135, 136 can pivot around a transverse axis 123 in articulation joints 133, 134 and in articulation joints 137, 138 as shown in FIG. 12 to assume a substantially vertical position.

Figure 12:
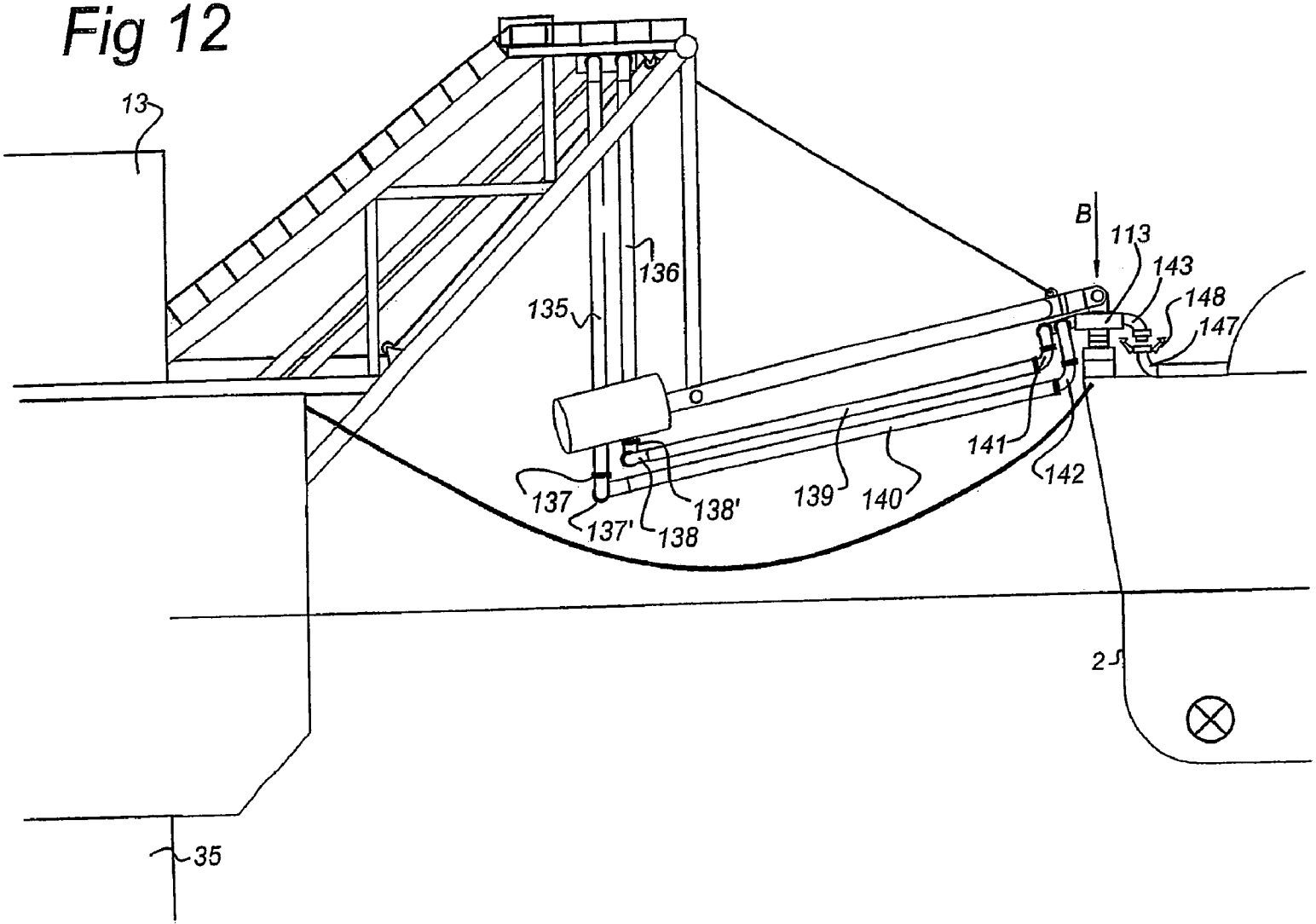

The horizontal ducts 139, 140 will also pivot around a vertical axis at swivels 137', 138' and a transverse axis a horizontal axis and a vertical arm at the position of two sets of each three perpendicular swivels 141, 142 until the mechanical connector 113 mates with receiving element 146 as shown in FIG. 12. After locking the mechanical connector 113, the fluid connector 143 is attached to piping 147 on deck of the buoy 80 by raising said piping and engaging clamps 148.

Figure 13:
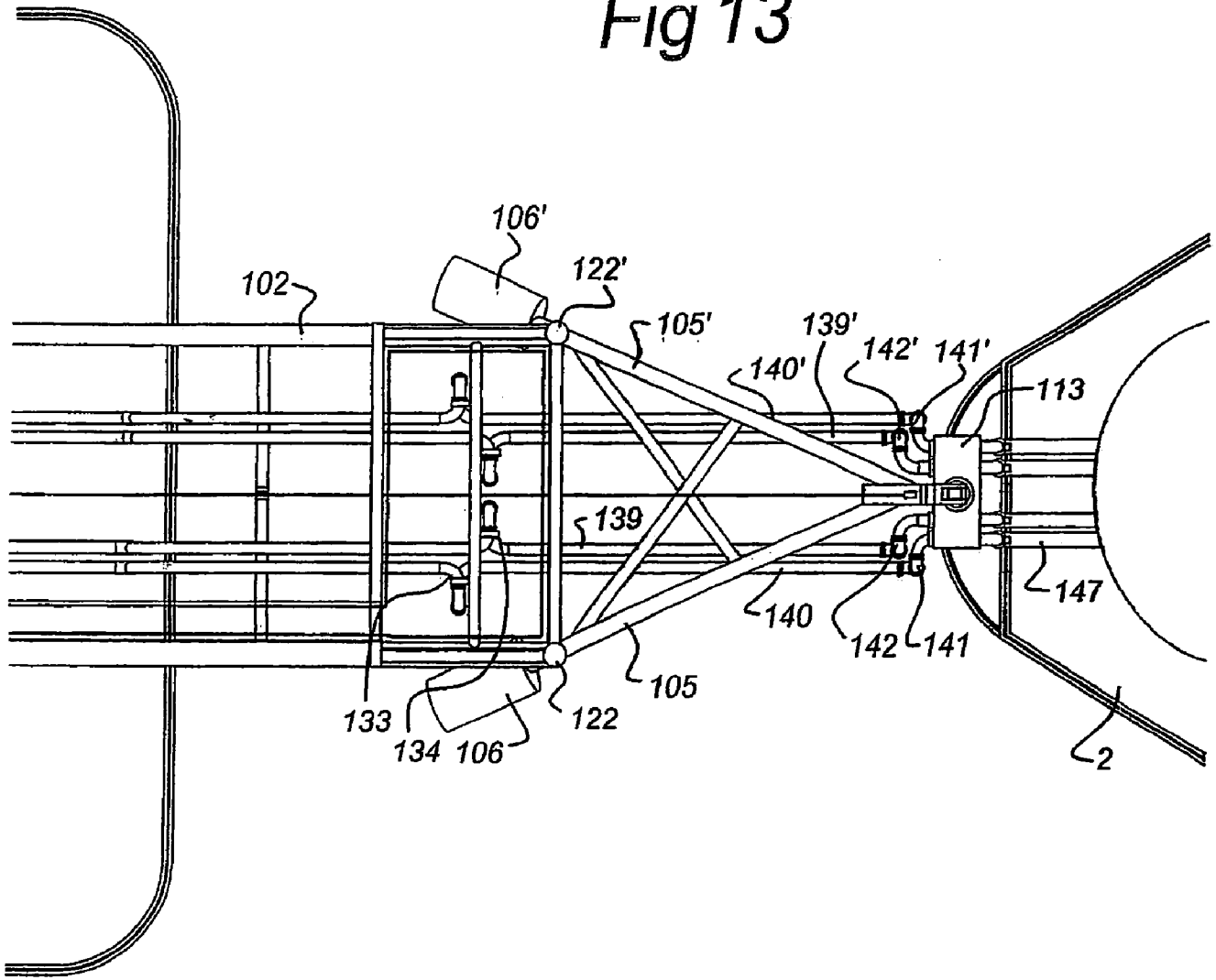
FIG. 13 shows a top plan view of the mooring system of FIG. 10.

FIG. 13 shows a top view of the mooring system in the connected state showing four pipes 139, 139', 140, 140' attached to the mechanical connector 113. The transfer pipes 135, 136 are connected to the support structure 102 in articulation joints 133, 134 and can pivot around a substantially longitudinal axis. The pipes 139, 139', 140, 140' are connected to the mechanical connector 113 in articulation joints 141, 141', 142, 142' and can pivot around a longitudinal, a transverse and a vertical axis. The pipes can move independently of the mooring arms 104, 104', 105, 105'.

Figure 14:
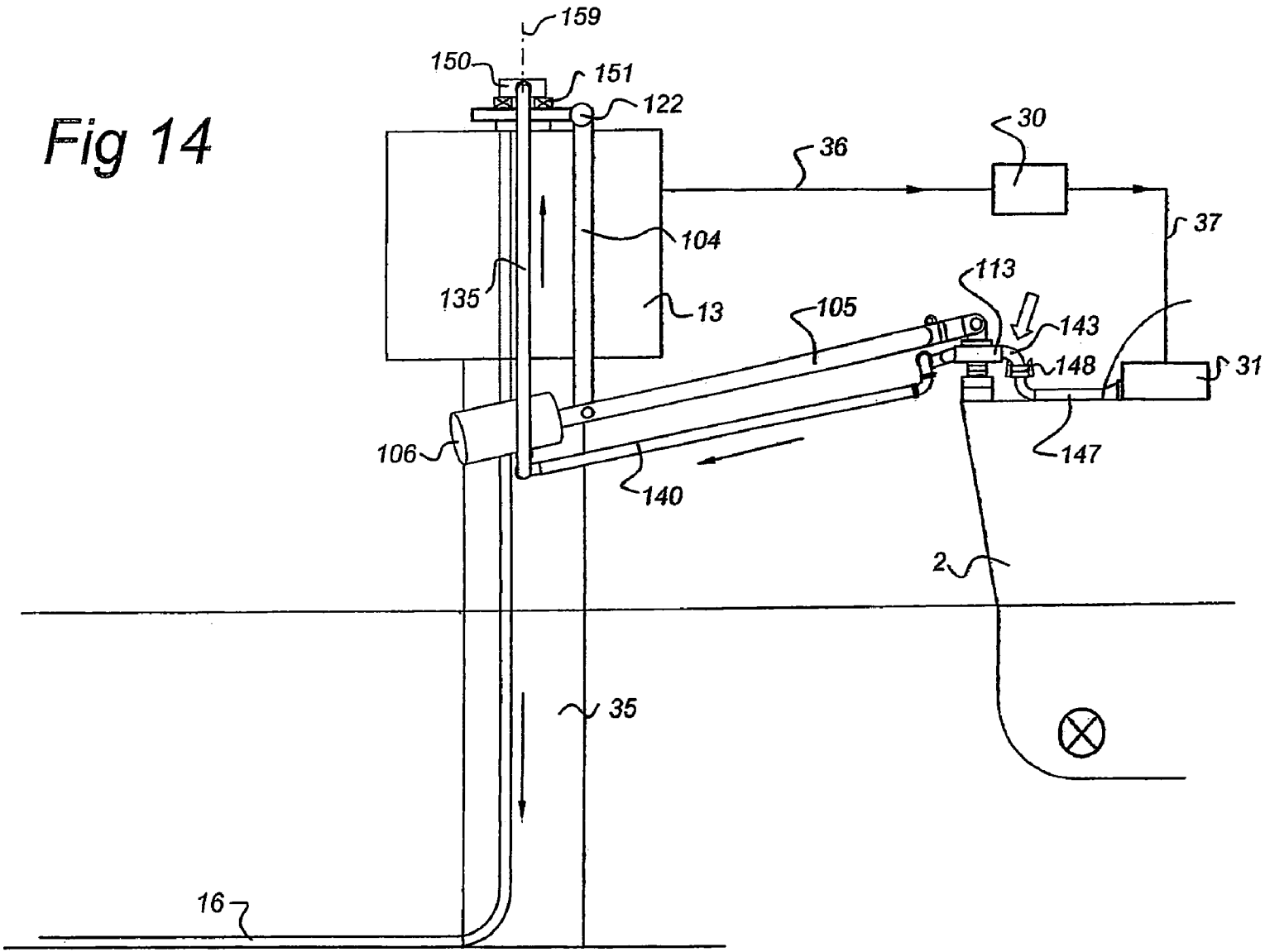
FIG. 14 show an alternative embodiment wherein the tanker vessel is moored to a tower via a soft yoke construction supported on the tower.

FIG. 14 shows a construction in which the tanker vessel 2 is directly moored to mooring tower 35 carrying regasification plant 13. A similar mooring structure is used as is shown in FIGS. 10–13. The vertical arms 104 are now depending directly from the tower 35 in pivot joint 122. The vertical cryogenic duct 135 is connected to a swivel 150, which can rotate around vertical axis 159, the swivel being supported on bearings 151. Also in this embodiment the tanker vessel 2 is offloaded from the bow and is connected to the tower 35 through horizontal mooring arms 105.

Figure 15:
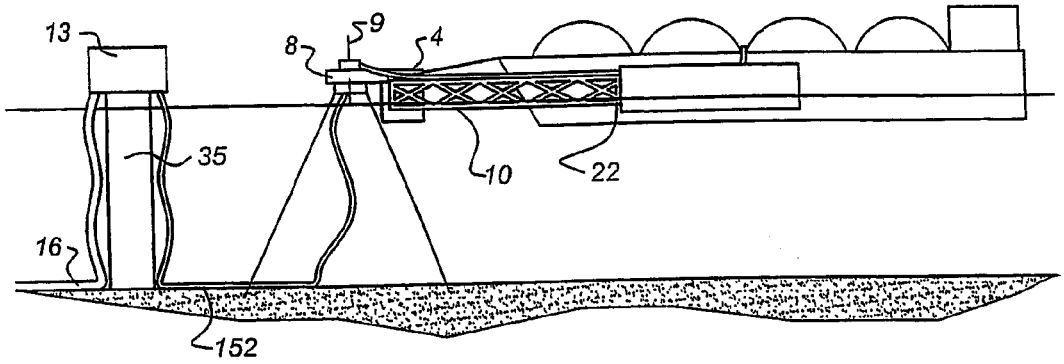
FIGS. 15 and 16 show embodiments wherein the regasification plant is placed at a relatively large distance from the moored vessel.

FIG. 15 shows an embodiment wherein the mooring buoy 8 is located at a large distance from a tower 35 such as for instance several hundreds of meters or kilometers, on which tower 35 the regasification plant 30 is supported. An intermediate LNG duct 152 extends along the seabed towards the regasification plant 13.

Figure 16:
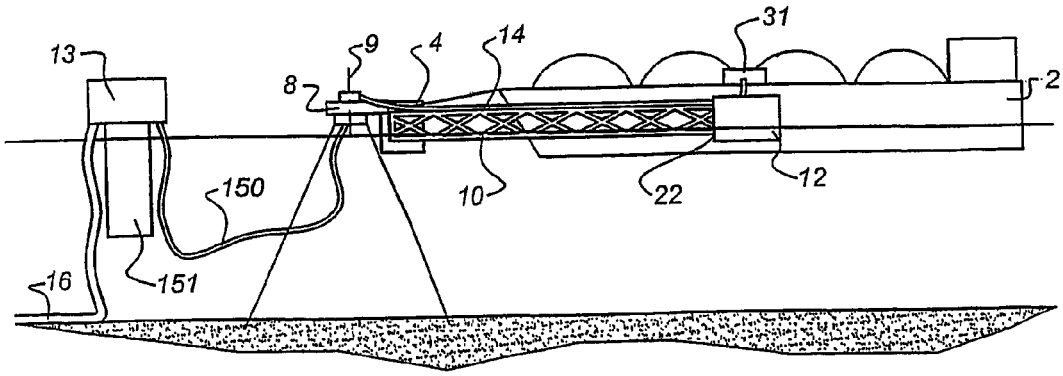

In the embodiment shown in FIG. 16, the regasification plant 13 is placed on a SPAR buoy or floating barge at a large distance from the tanker vessel 2. A mid depth LNG duct 150 connect the vessel to the regasification plant 13. Preferably, the middepth cryogenic transfer line 150 is configured in the form as described in European patent application 98201805.3 and 98202824.3, filed in the name of the applicant.

The invention claimed is:

1. Cryogenic fluid offloading system comprising:

an offshore mooring structure (4,5, 34,35, 51,50, 61,62, 72,73,80), connected to the seabed, a connecting member (10,26, 105,105') that is attached to the mooring structure with a first end (23,115, 115') to be displaceable around a vertical axis (9,39, 59,69, 79,89, 99,117, 159), a tanker vessel (2) for loading cryogenic fluid at a first location, transporting it and off loading the cryogenic fluid at a second location, the tanker vessel being connected to the mooring structure via the connecting member, a first fluid duct (16) connected to the mooring structure, for supplying fluid away from the mooring structure, a second fluid duct (14,131, 136,139, 150,152), connected to the mooring structure, for transporting fluid coming from the tanker vessel (2), to the mooring structure, a processing unit (13) for receiving a cryogenic fluid in liquid phase from the tanker vessel (2) and for supplying a gaseous phase of the fluid to the first fluid duct (16), and fluid supply means (31) for controlling supply of cryogenic fluid from the tanker vessel (12) to the processing unit (13), characterised in that the connecting member (10,26, 105,105') is connected with a second end (22, 113) to the tanker vessel (2), the vertical axis (9,39, 59,69, 79,89, 99,117, 159) being at least substantially in line with the tanker vessel (2) to allow displacement of the tanker vessel around the vertical axis, control means (30,36, 37) being provided for opening and closing of the fluid supply means (31) on the basis of a predetermined supply of the gaseous phase through the first fluid duct (16).

2. Cryogenic fluid offloading system according to claim 1, wherein the connecting member comprises an arm (10), the arm having a longitudinal section (20) with one end connected to a side of the tanker vessel (2) and extending in the length direction along the vessel towards the mooring structure (4,5, 34,35, 51,50, 61, 62,72, 73,80), and a transverse section (21) between the longitudinal section (20) and the mooring structure, substantially transverse to the length direction of the vessel.

3. Cryogenic fluid offloading system according to claim 2, wherein the length of the longitudinal section (20) of the arm (10) is at least ⅓ of the length of the tanker vessel (2).

4. Cryogenic fluid offloading system according to claim 2, the second fluid duct (14) being supported by the arm (10), the arm (10) being attached to the tanker vessel (2) at or near midship of the tanker vessel.

5. Cryogenic fluid offloading system according to claim 2, the longitudinal section (20) of the arm extending alongside the vessel and being connected to a floating structure (12,32) moored alongside the tanker vessel.

6. Cryogenic fluid offloading system according to claim 5, wherein the length of the floating structure is not more than ⅔ of the length of the tanker vessel.

7. Cryogenic fluid offloading system according to claim 5, wherein the processing unit (13) is placed on the floating structure (12,32).

8. Cryogenic fluid offloading system according to claim 5, wherein the length of the floating structure is not more than half of the length of the tanker vessel.

9. Cryogenic fluid offloading system according to claim 2, wherein the length of the longitudinal section (20) of the arm (10) is at least ½ of the length of the tanker vessel (2).

10. Cryogenic fluid offloading system according to claim 1, the mooring structure comprising a buoy (4,5, 61,62, 72,73), having a first part (5,61,73) attached to the sea bed and a second part (4,62, 72, rotatably connected to the first part around the vertical axis, the second part being attached to the connecting member (10).

11. Cryogenic fluid offloading system according to claim 1, wherein the processing unit is placed on a floating element (34,51, 61,62, 72,73), the connecting member (10) being with a first end (23) connected to the floating element (34,51, 61,62, 72,73).

12. Cryogenic fluid offloading system according to claim 11, the mooring structure comprising a tower (35,50) resting on the seabed(6), the tower being provided with at least one weight (41,42, 55) suspended from the tower such that it can be deflected away from a vertical equilibrium position, the floating element (34,51) being connected to the weight (41,42, 55) via a respective deflection member (44,45,54).

13. Cryogenic fluid offloading system according to claim 11, the mooring structure comprising a tower (54) connected to the seabed, a top end of the tower being located below water level, the floating element (51) being attached with at least two cables (54) to the tower, the cables being provided with a restoring weight (55), wherein the floating element has a vertical shaft (52) between an upper and a lower part, a flexible fluid duct (53) extending from the processing unit (13) to the tower (54) via the shaft and being attached to the first fluid duct.

14. Cryogenic fluid offloading system according to claim 11, the floating element having an inner member (61) that is moored to the sea bed and that supports the processing unit (13), and an outer member (62) which can rotate around the inner member, connected to the connecting member (10).

15. Cryogenic fluid offloading system according to claim 11, the floating element having a buoyancy body (72) and a lower connector (73) that is moored to the sea bed (6) and that is rotatably connected to the buoyancy body (72).

16. Cryogenic fluid offloading system according to claim 11, a flexible fluid duct (53,66) extending from the floating element from at or near sea level to a predetermined depth below water level.

17. Cryogenic fluid offloading system according to claim 1, the mooring structure comprising a tower (35) connected to the seabed, the processing unit (13) being placed on the tower, the connecting member (10) being attached to the tower in an articulation joint (91,92) that can rotate around the vertical axis (99) and pivot around a substantially transverse axis.

18. Cryogenic fluid offloading system according to claim 1, the first fluid duct (16) being attached to the second fluid duct (14) via a first arm (82) attached to the mooring structure (35) and a second arm (83), substantially vertically supported by the first arm, the connections of the first arm to the mooring structure, of the first arm (82) to the second arm and of the second arm (83) to the second fluid duct (14), comprising at least six swivels.

19. Cryogenic offloading system according to claim 1, the mooring structure comprising a tower (35) resting on the seabed (6), the tower being provided with at least one suspension element (104,104'), carrying a substantially horizontal arm (105,105'), and being connected to a restoring weight (106), the processing unit(13) being placed on the tower(35).

20. Cryogenic fluid offloading system according to claim 1, wherein the processing unit (13) comprises no LNG storage tanks that are larger than the volume of the LNG storage tanks of the tanker.

21. Cryogenic fluid offloading system according to claim 1, wherein the processing unit (13) comprises no LNG storage tanks that are larger than the ½ of volume of the LNG storage tanks of the tanker.

22. Cryogenic fluid offloading system according to claim 1, wherein the processing unit (13) comprises no LNG storage tanks that are larger than ⅓ of the volume of the LNG storage tanks of the tanker.

23. Cryogenic of f loading system comprising:

an offshore mooring structure (4,5, 34,35, 51,50, 61,62, 72,73, 80), connected to the seabed, a connecting member (10,105,105') that is attached to the mooring structure with a first end (23,115, 115') to be displaceable around a vertical axis (9,39, 59,69, 79,89, 99,117, 159), a tanker vessel (2) for loading cryogenic fluid at a first location, transporting it and offloading the cryogenic fluid at a second location, the tanker vessel being connected to the mooring structure via the connecting member, a first fluid duct (16) connected to the mooring structure, for supplying fluid away from the mooring structure, a second fluid duct (14,131, 136,139, 150,152), connected to the mooring structure, for transporting fluid coming from the tanker vessel (2), to the mooring structure, a processing unit (13) for receiving a cryogenic fluid in liquid phase from the tanker vessel (2) and for supplying a gaseous phase of the fluid to the first fluid duct (16), and fluid supply means (31) for controlling supply of cryogenic fluid from the tanker vessel (12) to the processing unit (13), characterised in that the processing unit (13) is spaced at a distance of at least several tens of meters, the mooring structure being connected via an LNG duct (150,152) to the processing unit.

24. Cryogenic offloading system according to claim 23, the processing unit being placed on one of a tower (35) and a buoy (151).

25. Cryogenic offloading system according to claim 23, wherein, the processing unit (13) is spaced at a distance of at least several hundreds of meters from the mooring structure, the mooring structure being connected via an LNG duct (150,152) to the processing unit.

26. Cryogenic offloading system according to claim 23, wherein, the processing unit (13) is spaced at a distance of at least several kilometers from the mooring structure, the mooring structure being connected via an LNG duct (150, 152) to the processing unit.

* * * * *